US009408508B2

(12) United States Patent
Brown

(10) Patent No.: US 9,408,508 B2
(45) Date of Patent: Aug. 9, 2016

(54) PORTABLE POTTY

(71) Applicant: Princess Marie Brown, St Louis, MO (US)

(72) Inventor: Princess Marie Brown, St Louis, MO (US)

( * ) Notice: Subject to any disclaimer, the term of this patent is extended or adjusted under 35 U.S.C. 154(b) by 180 days.

(21) Appl. No.: 14/167,626

(22) Filed: Jan. 29, 2014

(65) Prior Publication Data

US 2015/0208882 A1 Jul. 30, 2015

(51) Int. Cl.
*A47K 11/06* (2006.01)

(52) U.S. Cl.
CPC ..... *A47K 11/06* (2013.01); *Y10T 29/49826* (2015.01)

(58) Field of Classification Search
CPC ..... A47K 11/02; A47K 11/04
See application file for complete search history.

(56) References Cited

U.S. PATENT DOCUMENTS

| | | | | | |
|---|---|---|---|---|---|
| 3,771,493 | A * | 11/1973 | Chandor | A01K 1/0107 | 119/170 |
| 5,265,285 | A * | 11/1993 | Loebbert | A47K 11/04 | 4/484 |
| 5,779,306 | A * | 7/1998 | Ohlsson | A47K 13/06 | 297/182 |
| 6,038,711 | A * | 3/2000 | Clarke | A47K 11/04 | 4/449 |
| 7,334,273 | B2 | 2/2008 | Thomas | | |
| 2004/0221379 | A1* | 11/2004 | Hinton | A47K 13/005 | 4/254 |
| 2011/0052838 | A1* | 3/2011 | Levkovitch | A01K 5/0128 | 428/12 |

OTHER PUBLICATIONS

Cool Gear Travel Potty, by Cool Gear https://www.babyhaven.com/cool-gear-travel-potty.html?utm_source=google&utm_medium=cse&gclid=CPqkiLTSjbwCFOto7A odehQAKA; Jan. 23, 2014.

3 Best Traveling Training Potty http://www.the3best.net/Reviews/3-Best-Travel-Training-Potty; Jan. 23, 2014.

*Fisher Price 2 in 1 Portable Potty* ($16.17-$29.99); [*AD*—lets mom keep training easy as she goes out & about town or as family travels. For travel theres full potty chair that uses standard small kitchen bags for collection, plus it features folding legs so it can tuck away easily in the car or a bag. For shopping trips or playdates, theres a potty ring so toddlers can use public restrooms with a ring sized just for them that more sanitary. The ring has its own carry bag so mom can be discreet about toting it around. A guard is included for boys.] http://www.pottytrainingconcepts.com/CTGY/Travel-Potty-Chair.html; Jan. 23, 2014.

*Potette Plus 2-in-1 Portable Potty & Trainer*; By: Kalencom Corporation Kiddicare Toilet Training Seat (various colors) ($1.99=$2.00) http://www.pottytrainingconcepts.com/CTGY/Travel-Potty-Chair.html; Jan. 23, 2014.

(Continued)

*Primary Examiner* — Janie Loeppke
(74) *Attorney, Agent, or Firm* — Foley & Lardner LLP

(57) ABSTRACT

A portable potty includes a seat member, a first support member connected to the seat member, a second support member connected to the first support member, and a third support member connected to the second support member. The portable potty can be repeatedly and reversibly transformed from a collapsed position to a constructed position. When the portable potty is in the collapsed position, the first support member and the second support member are stacked substantially parallel with respect to an adjacent member, in a vertical direction. When the portable potty is in the constructed position, the seat member is disposed perpendicular to the first, second and third support members such that a space is formed, the space being bordered by the first, second and third support members.

19 Claims, 6 Drawing Sheets

(56) References Cited

OTHER PUBLICATIONS

*My Carry Potty by regal Lager* $29.00 http://www.pottytrainingconcepts.com/CTGY/Travel-Potty-Chair.html; Jan. 23, 2014.
*On the Go*—Travel Potty Chair http://www.pottytrainingconepts.com/CTGY/Travel-Potty-Chair.html; Jan. 23, 2014.
*Twisting Travel Potty Chair* by Graco http://www.pottytrainingconcepts.com/CTGY/Travel-Potty-Chair.html; Jan. 23, 2014.
Mother's Helper toilet seat http://www.mommyshelperinc.com/cushie_stepup.htm; Jan. 23, 2014.
Consumer Search Best Travel Potty link http://www.consumersearch.com/baby-potties/best-travel-potty; Jan. 23, 2014.

* cited by examiner

PORTABLE POTTY

FIELD OF THE INVENTION

The present invention relates generally to the field of portable potties. More specifically, the present invention relates to collapsible portable potties for children.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

When potty training children, it is often difficult to get a child accustomed to using a toilet when the child is at a location outside of the home. In order to habituate the child to using his or her "potty," it would be ideal to bring the potty everywhere the child goes. Realistically, it would be difficult to transport the child's potty, for example, while running errands or traveling, because conventional potties are rigid and bulky. In addition, the child might be embarrassed to be carrying the potty. Although portable potties are known in the art, they are still large and bulky because they typically include a seat with retractable legs. In addition, in order to conceal the portable potty, manufacturers may include a travel case similar to a briefcase.

A need exists for improved technology, including technology that may address the above described disadvantages by providing a portable potty that is stylish, compact, and easy to construct and collapse.

SUMMARY

One embodiment of the invention relates to a portable potty including a seat member, a first support member connected to the seat member, a second support member connected to the first support member, and a third support member connected to the second support member. The portable potty can be repeatedly and reversibly transformed from a collapsed position to a constructed position. When the portable potty is in the collapsed position, the first support member and the second support member are stacked substantially parallel with respect to an adjacent member, in a vertical direction. When the portable potty is in the constructed position, the seat member is disposed perpendicular to the first, second and third support members such that a space is formed, the space being bordered by the first, second and third support members.

Another embodiment of the invention relates to a method for using a portable potty that includes a triangular seat member having a first side, a second side and a third side, a first support member connected to the seat member, a second support member connected to the first support member, and a third support member connected to the second support member. The method includes constructing the portable potty into a constructed position in which the seat member is disposed substantially perpendicular to the first, second and third support members such that a space is formed, the space being bordered by the first, second and third support members, the first side of the seat member contacts the first support member, the second side of the seat member contacts the second support member, and the third side of the seat member contacts the third support member. The method further includes collapsing the portable potty into a collapsed position in which the first support member and the second support member are stacked substantially parallel with respect to an adjacent member, in a vertical direction, such that the second support member is disposed in a top most position and the first support member is disposed in a bottom most position. In the collapsed position, the seat member is disposed within a recessed portion of the first support member, and the third support member is disposed within a recessed portion of the second support member.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE DRAWINGS

The accompanying drawings, which are included to provide further understanding of the invention, are incorporated in and constitute a part of this specification, illustrate embodiments of the present disclosure and together with the detailed description serve to explain the principles of the present disclosure. No attempt is made to show structural details of the present disclosure in more detail than may be necessary for a fundamental understanding of the present disclosure and the various ways in which it may be practiced.

DETAILED DESCRIPTION

Figure 1B:
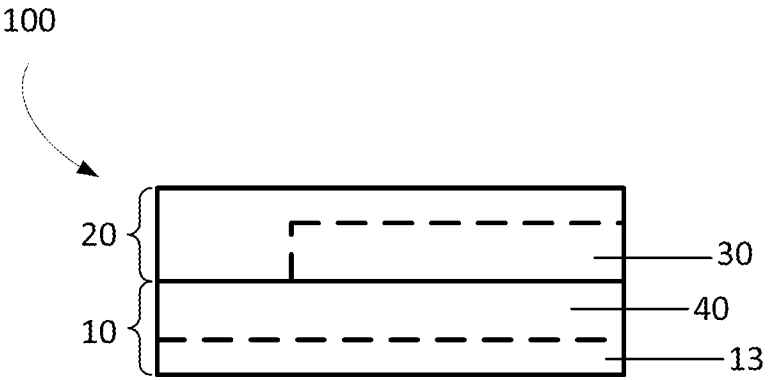
FIG. 1B is a schematic side, cross-sectional view of the portable potty in the collapsed position of FIG. 1A.

Before turning to the figures, which illustrate the exemplary embodiments in detail, it should be understood that the present disclosure is not limited to the details or methodology set forth in the description or illustrated in the figures. It should also be understood that the terminology is for the purpose of description only and should not be regarded as limiting. An effort has been made to use the same or like reference numbers throughout the drawings to refer to the same or like parts.

Referring to FIGS. 1A-6, a portable potty 100 includes a first support member 10, a second support member 20, a third support member 30 and a seat member 40. In one embodiment, the first support member 10, the second support member 20, the third support 30 and the seat member 40 are made of plastic. In other embodiments, the first support member 10, the second support member 20, the third support 30 and the seat member 40 may be made of another material, provided the material is lightweight and generally resistant to liquids. The first support member 10, the second support member 20, the third support 30 and the seat member 40 may be provided in any color. In addition, the first support member 10, the second support member 20, the third support 30 and the seat member 40 may be transparent, translucent or opaque. Moreover, the first support member 10, the second support member 20, the third support 30 and the seat member 40 may be decorated with decals or stickers 60 to personalize the portable potty 100. For example, the decals or stickers 60 may include images of objects, artistic designs or a child's name.

Figure 1A:
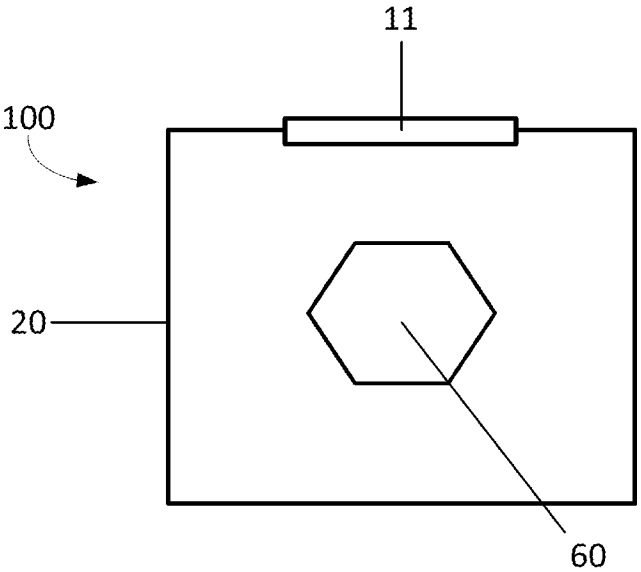
FIG. 1A is a top view of a portable potty in a collapsed position, according to one embodiment.

Referring to FIGS. 1A and 1B, when the portable potty 100 is in a collapsed position, the first support member 10 and the second support member 20 are stacked substantially parallel with respect to an adjacent member, in a vertical direction. In the collapsed position, the members are stacked such that the second support member 20 is disposed in a top most position and the first support member 10 is disposed in a bottom most position (see FIG. 1B).

The first support member 10 is concave (i.e., has a recessed portion) such that the seat member 40 and a pocket 13 (described in further detail below) may be disposed within the recessed portion, allowing adjacent faces of the first support member 10 and the second support member 20 to lay flat and abut each other when the portable potty 100 is in the collapsed position. Similarly, the second support 20 contains a recessed portion 22 such that the third support member 30 may be disposed within the recessed portion 22, allowing the adjacent faces of the first support member 10 and the second support member 20 to lay flat and abut each other when the portable potty 100 is in the collapsed position. The recessed portion of the first support member 10 may be deeper than the recessed portion 22 of the second support member 20, as the first support member 10 houses more parts. The recessed portion of the first support member 10 and the recessed portion 22 of the second support member 20 are provided in order to minimize a total height of the portable potty 100 when the portable potty 100 is in the collapsed position.

In the collapsed position, the members are stacked within the first support member 10 and the second support member 20 such that the third support member 30 is disposed between the second support member 20 and the seat member 40, the seat member 40 is disposed between the third support member 30 and the pocket 13, and the pocket 13 is disposed between the seat member 40 and the first support member 10 (see FIG. 1B).

The first support member 10 includes a latch 11 configured to secure the second support member 20 to the first support member 10 when the portable potty is in the collapsed position. The latch 11 may be disposed, for example, on a top edge of the first support member 10. One of ordinary skill in the art will appreciate that in other embodiments, the latch 11 may be disposed at different locations, for example, a side edge or a bottom edge of the first support member 10, or a top edge, a bottom edge, or a side edge of the second support member 20.

The portable potty 100 has a shape and a size that gives the portable potty 100 an appearance similar to a tablet or a small laptop when the portable potty 100 is in the collapsed position. For example, in one embodiment, in the collapsed position, the portable potty 100 has a length of 8 inches or less, a width of 12 inches or less, and a height of 1 inch or less. The compact shape and size of the portable potty 100 allows the portable potty 100 to be transported in a purse, a tote bag (e.g., a reusable grocery bag), a diaper bag, or a book bag. In addition, the portable potty 100 may be placed in a seat pouch in a vehicle while traveling.

Figure 2A:
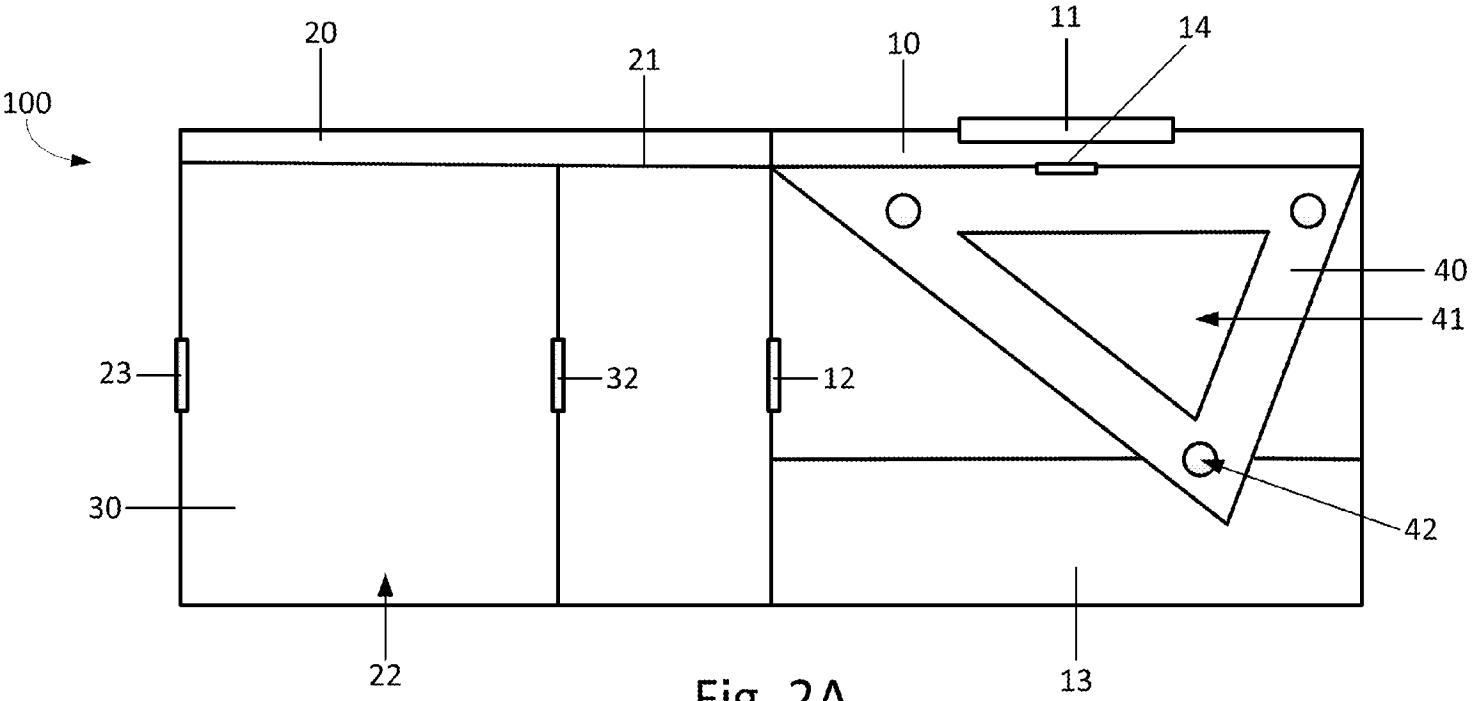
FIG. 2A is a top view of the portable potty of FIG. 1A in a first expanded position.
Figure 2B:
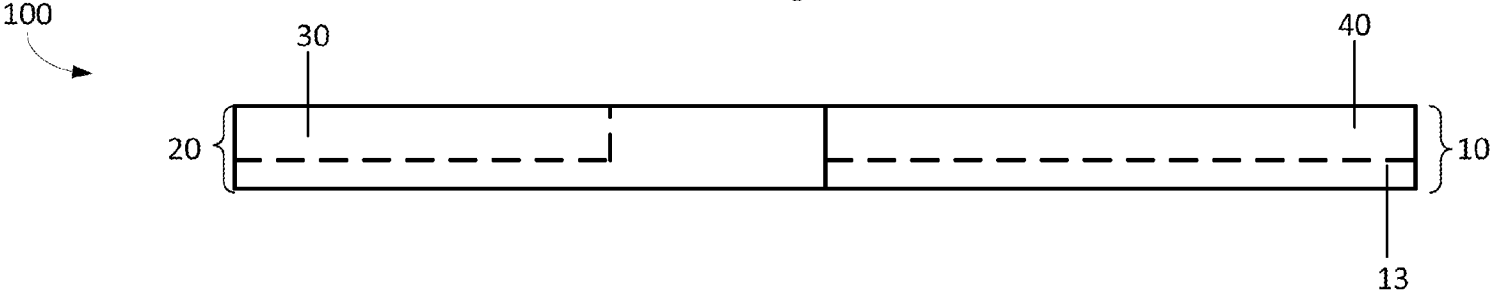
FIG. 2B is a schematic side, cross-sectional view of the portable potty in the first expanded position of FIG. 2A.

Referring now to FIGS. 2A and 2B, to place the portable potty 100 in a first expanded position from the collapsed position, the latch 11 is released and the second support member 20 is rotated about a connection 12 between the first support member 10 and the second support member 20 in a manner similar to an action of opening a book. The connection 12 may be any suitable connection, for example, a hinge. In the first expanded position, the first support member 10 and the second support member 20 may lay side by side, with the third support member 30 remaining disposed within the recessed portion 22 of the second support member 20 and the seat member 40 and the pocket 13 remaining stacked within the recessed portion of the first support member 10. A width of the recessed portion of the first support member 10 may be, for example, the same as the width of the first support member 10. A length of the recessed portion of the first support member 10 may be, for example, slightly longer than a length extending from a side of the seat member 40 connected to the first support member 10 to a bottom edge of the first support member 10, in order to accommodate a connection 14 (described in further detail below).

As seen in FIG. 2A, the seat member 40 has a substantially triangular shape. In the embodiment of FIG. 2A, the seat member 40 has a shape of an isosceles triangle. In other embodiments, the seat member 40 may have a shape of a different type of triangle, for example, an equilateral triangle. The first support member 10, the second support member 20 and the third support member 30 have a substantially rectangular shape. In other embodiments, corners of at least one of the first support member 10, the second support member 20, the third support member 30 and the seat member 40 may be rounded.

As illustrated in FIG. 2A, the first support member 10 is connected to the seat member 40 by a connection 14. The third support member 30 is connected to the second support member 20 by a connection 23. The connections 14 and 23 may be any suitable connection, for example, a hinge.

The first support member 10 optionally includes the pocket 13 configured to hold relatively flat or compressible items such as disposable liners 70. The disposable liner 70 may be formed from a biodegradable, absorbent flushable liner providing a user with an option of flushing the biodegradable absorbent material. Alternatively, the user has an option of wrapping up or tying the disposable liner 70, and disposing of the disposable liner 70 in a garbage can, in a manner similar to throwing away a disposable diaper. Use of the disposable liners 70 will be described in further detail below.

The second support member 20 may include a ledge 21 extending along a width of the second support member 20. The ledge 21 has substantially a same length as a side of the seat member 40 such that when the portable potty 100 is in the constructed position, the seat member 40 rests upon the ledge 21. The constructed position will be described in further detail below. The ledge 21 may define, at least in part, the recessed portion 22 of the second support member 20. A length of the recessed portion 22 of the second support member 20 may be, for example, the same as the length of the third support member 30. A width of the recessed portion 22 may be, for example, slightly larger than the width of the third support member 30 in order to accommodate a connecter 32 (described in further detail below).

The third support member 30 may include a connector 32 disposed at a side edge opposite to an edge at which the connection 23 is provided. The connector 32 may be, for example, a latch, Velcro, a magnet, or any other suitable connector. Operation of the connector 32 will be described in further detail below.

The seat member 40 includes an aperture 41 extending through a center thereof. The aperture 41 is of a sufficient size to prevent a child from falling through the aperture 41 when the child sits on the seat member 40. The aperture 41 is generally a same shape as the seat member 40. The seat member 40 may be cushioned for comfort, provided the cushioning does not significantly increase the height of the portable potty 100 when the portable potty 100 is in the collapsed position.

The seat member 40 further includes a plurality of fasteners 42 configured to receive and secure the disposable liner 70. For example, the fasteners 42 may be serrated holes, clips, Velcro, magnets, or any other suitable fastener. In cases in which serrated holes or clips are used as the fasteners 42, the disposable liner 70 is secured by inserted a portion of an edge of the disposable liner 70 in each serrated hole or clip. In cases in which Velcro or magnets are used as the fasteners 42, an appropriate corresponding portion of the disposable liner 70 is placed on top of the fasteners 42.

Figure 3A:
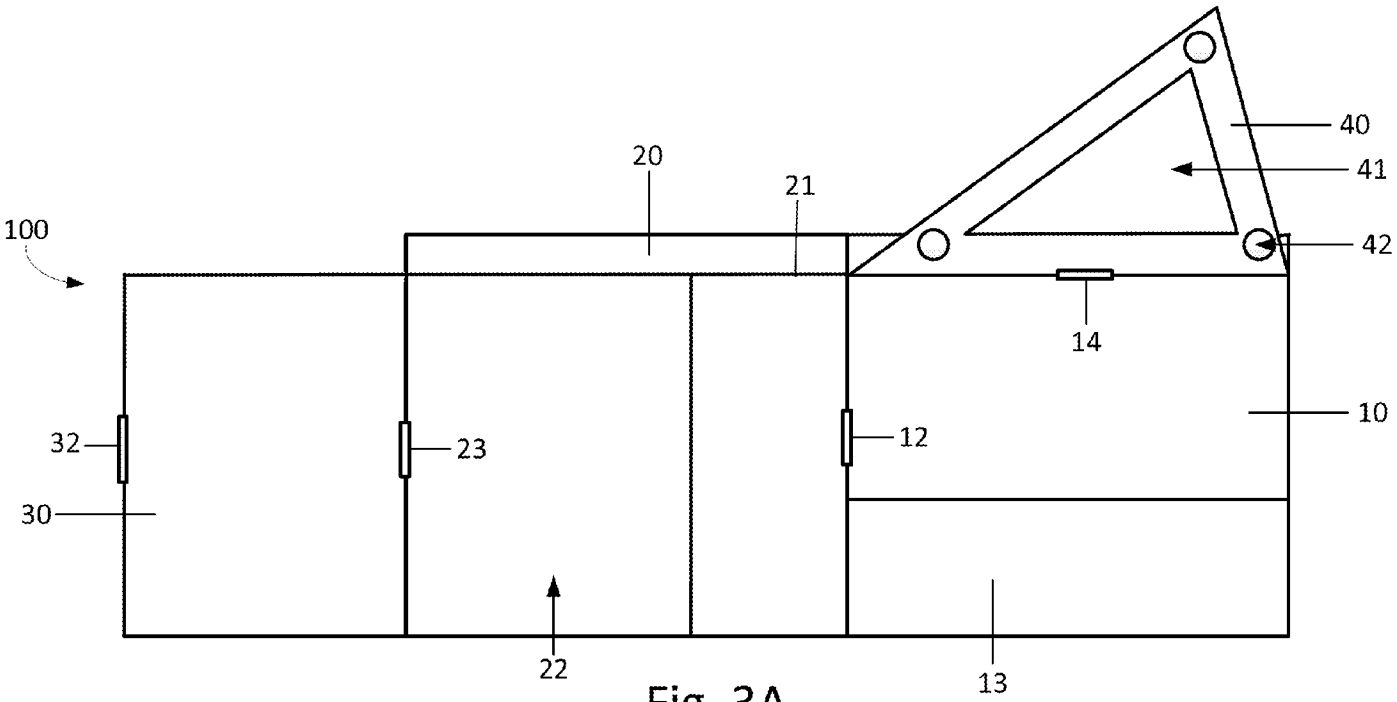
FIG. 3A is a top view of the portable potty of FIG. 1A in a second expanded position.
Figure 3B:
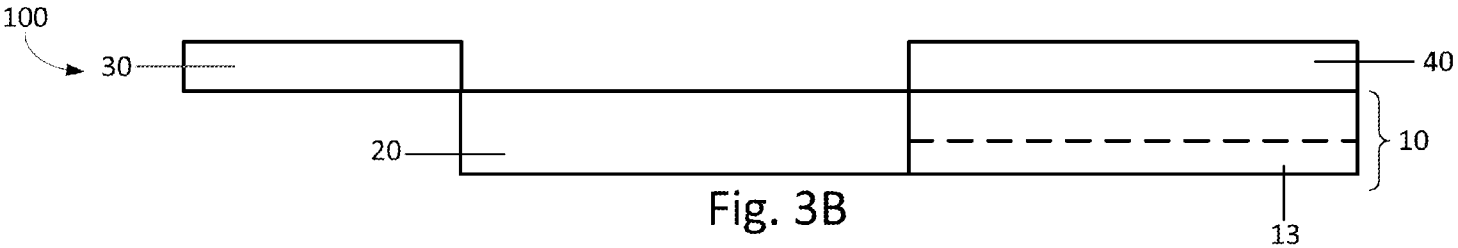
FIG. 3B is a schematic side, cross-sectional view of the portable potty in the second expanded position of FIG. 3A.

Referring now to FIGS. 3A and 3B, to place the portable potty 100 in a second expanded position from the first expanded position, the seat member 40 is flipped up and away from the first support member 10 by rotating the seat member 40 about the connection 14. The third support member 30 is unfolded from the second support member 20 by rotating the third support member 40 about the connection 23. One of ordinary skill in the art will appreciate that the seat member 40 may be flipped up before, after, or at the same time the third support member 30 is unfolded. In the second expanded position, the first support member 10 and the second support member 20 may lay side by side, with the third support member 30 stacked on top of the second support member 20 and the seat member 40 stacked on top of the first support member 10. In the second expanded position, the third support member 30 protrudes from the second support member 20 without substantially overlapping the second support member 20 (except for a minimal overlap at a portion of the connection 23). In addition, the seat member 40 protrudes from the first support member 10 without substantially overlapping the first support member 10 (except for a minimal overlap at a portion of the connection 14). In the second expanded position, the seat member 40 and the third support member 30 are no longer disposed within the recessed portion of the first support member 10 and the recessed portion 22 of the second support member 20, respectively.

As seen in FIGS. 2A and 3A, the first support member 10, the second support member 20, the third support member 30 and the seat member 40 are formed into a single piece assembly. In other words, if the portable potty 100 is dropped while in the collapsed position, the first expanded position, the second expanded position or a constructed position (described below), the members of the portable potty 100 will remain connected (i.e., there are no loose pieces).

Figure 4:
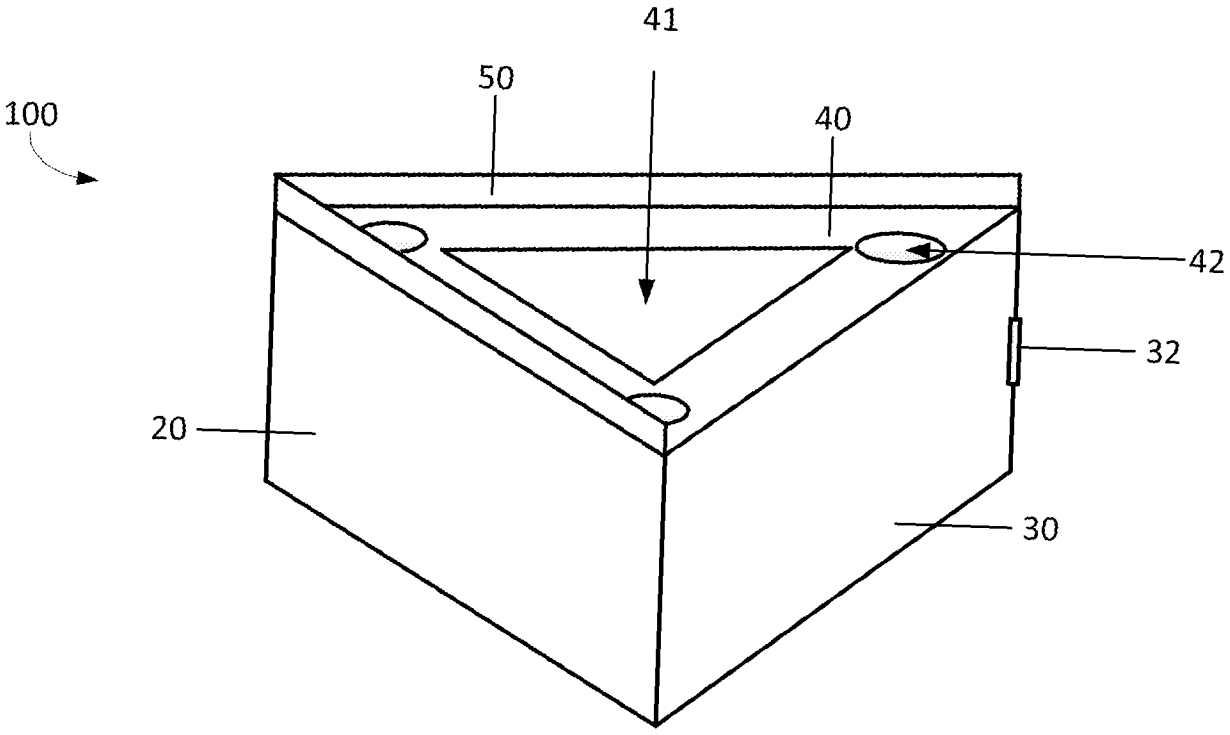
FIG. 4 is an isometric view of the portable potty of FIG. 1A in a constructed position.

Referring now to FIG. 4, to place the portable potty 100 in a constructed position from the second expanded position, the third support member 30 is connected to the first support member 10 via the connector 32 such that a triangular space bordered by the first support member 10, the second support member 20 and the third support member 30 is created. The seat member 40 is pushed down such that a first side of the seat member 40 contacts the first support member 10, a second side of the seat member 40 contacts the second support member 20 and a third side of the seat member 40 contacts the third support 30. The second side of the seat member 40 may rest upon the ledge 21 of the second support member 20 to provide stable and secure seating. One of ordinary skill in the art will appreciate that in an alternative, but not mutually exclusive method for transforming the portable potty 100 into the constructed position, it is also possible to first push down on the seat member 40 such that the second side of the seat member 40 rests upon the ledge 21, and then connect the third support member 30 to the first support member 10 via the connector 32. In the constructed position, the seat member 40 is disposed substantially perpendicular to the first support member 10, the second support member 20 and the third support member 30.

Referring back to FIGS. 2A and 3A, the seat member 40 is connected to the first support member 10 via the connection 14 located offset from a top edge of the first support member 10. The ledge 21, upon which the seat member 40 is configured to rest in the constructed position, is located offset and below a top edge of the second support member 20. The size of the offset between the top edge of the first support member 10 and the seat member 40 and the offset between the top edge of the second support member 20 and the ledge 21 are substantially equal. As a result, when the portable potty 100 is in the constructed position, an L-shaped ledge 50 is formed between the seat member 40 and the first support member 10 and the second support member 20. A height of the L-shaped ledge 50 is equal to the size of the offsets. The L-shaped ledge 50 is configured to provide secure seating.

Figure 5:
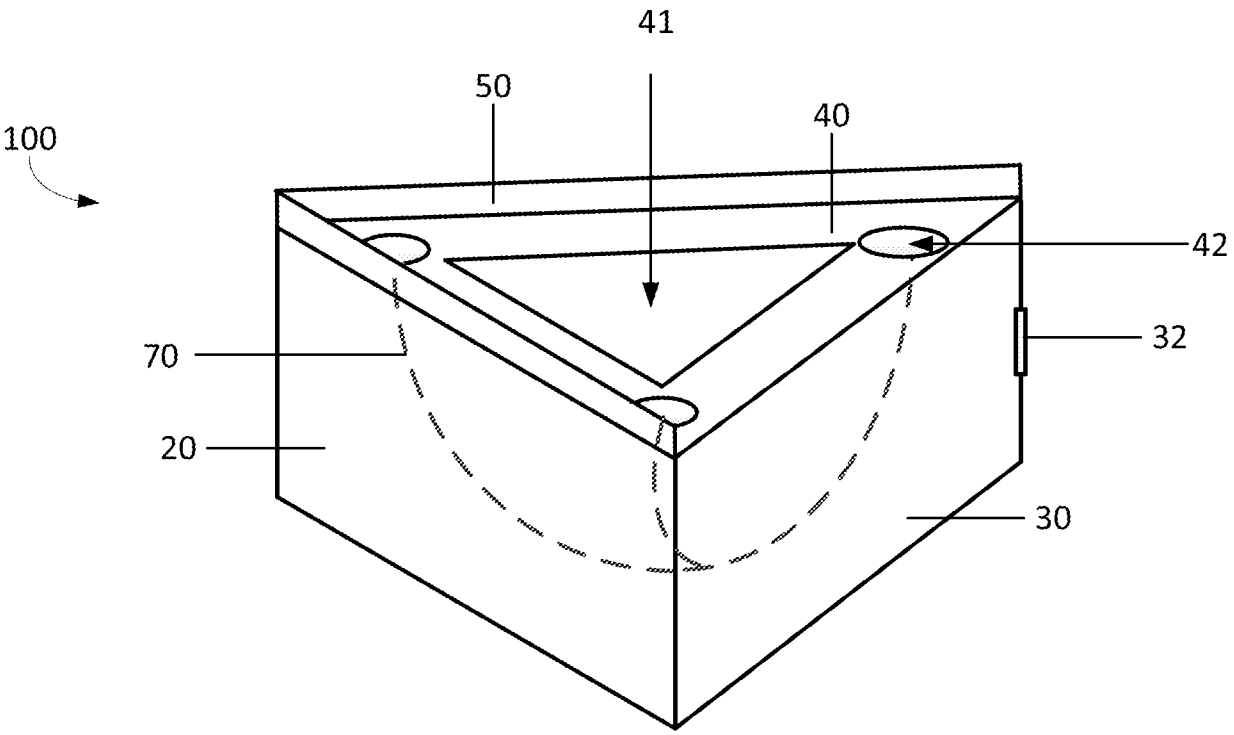
FIG. 5 is an isometric view of the portable potty of FIG. 4 with a disposable liner inserted.

The portable potty 100 is configured to be used for potty training when in the constructed position. Referring to FIG. 5, the disposable liner 70 is inserted through the aperture 41 in the seat member 40 and received in the space bordered by the first support member 10, the second support member 20 and the third support member 30. The disposable liner 70 is secured to the portable potty 100 by the fasteners 42. The disposable liner 70 may be inserted through the aperture 41 before or after the portable potty 100 is in the constructed position.

After the child has finished using the portable potty 100, the disposable liner 70 is unfastened from the fasteners 42, removed from the portable potty 100 and disposed of. The third support member 30 may be disconnected from the first support member 10, allowing the disposable liner 70 to be removed from its location below the seat member 40. Alternatively, the disposable liner 70 may be pulled up through the aperture 41 without first disconnecting the third support member 30 from the first support member 10. The disposable liner 70 provides for easy clean up and disposal of waste.

Figure 6:
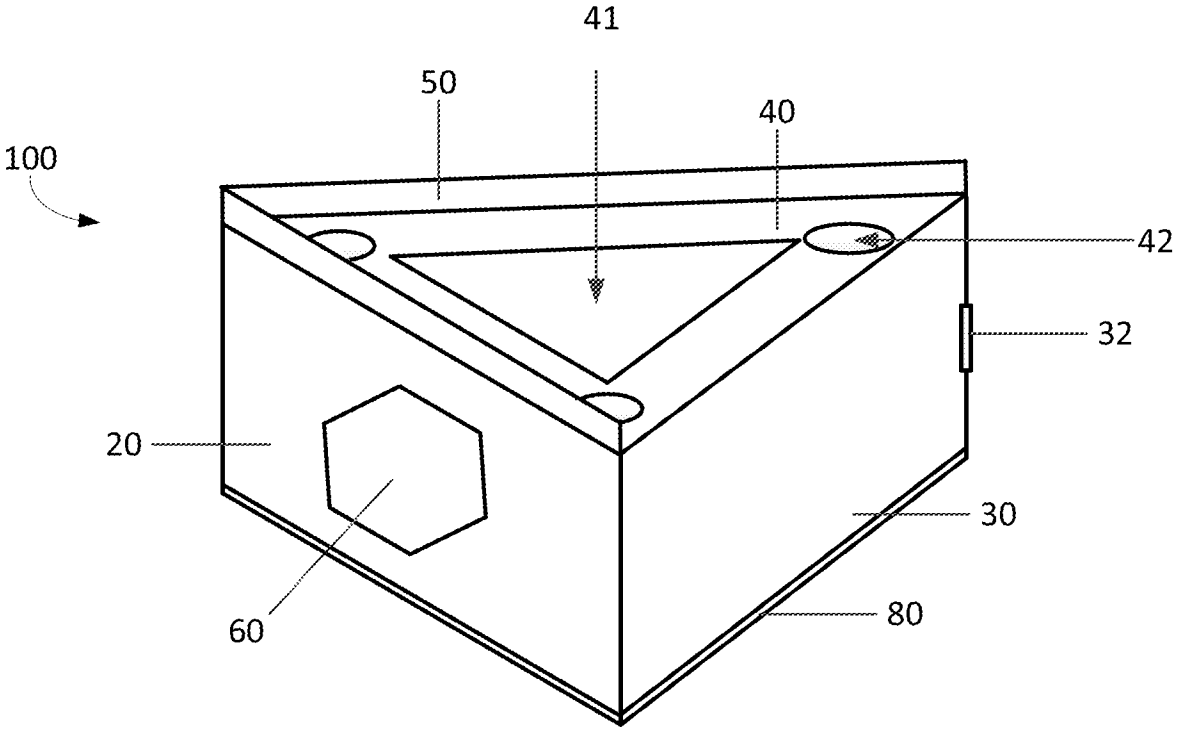
FIG. 6 is an isometric view of the portable potty of FIG. 4 with bottom edges lined with rubber to prevent the portable potty from slipping.

Referring now to FIG. 6, bottom edges of the first support member 10, the second support member 20 and the third support member 30 may be lined, for example, with rubber or plastic to prevent the portable potty 100 from slipping or sliding on a surface when in use (i.e., in the constructed position). In addition, the decals or stickers 60 may be placed on the portable potty 100 while the portable potty 100 is in the constructed position, to ensure that the decals or stickers 60 are located in desired positions.

One of ordinary skill in the art will appreciate that any of the connections or latches described herein may be provided within at least one of the recessed portion of the first support member 10 or the recessed portion 22 of the second support member 20, in order to minimize a total height of the portable potty 100 when the portable potty 100 is in the collapsed position. In addition, by recessing the connections or latches, adjacent faces of the first support member 10 and the second support member 20 may lay flat and abut each other, such that the portable potty 100 is substantially flat when in the collapsed position.

The portable potty 100 of the embodiments described above is stylish, compact, and easy to construct and collapse. The portable potty 100 can be repeatedly and reversibly transformed from the collapsed position to the constructed position. When in the collapsed position, the portable potty 100 does not have an appearance of a potty, but instead has an appearance similar to a tablet or a small laptop when the portable potty 100 is in the collapsed position. The compact shape and size of the portable potty 100 allows the portable potty 100 to be conveniently transported in a purse, a tote bag (e.g., a reusable grocery bag), a diaper bag, or a book bag. In addition, the portable potty 100 may be placed in a seat pouch in a vehicle while traveling.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the portable potty as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A portable potty comprising:

a seat member having an aperture extending through a center thereof;

a first support member connected to the seat member;

a second support member connected to the first support member; and a third support member connected to the second support member, wherein the portable potty can be repeatedly and reversibly transformed from a collapsed position to a constructed position, wherein when the portable potty is in the collapsed position, the first support member and the second support member are stacked substantially parallel with respect to one another, in a vertical direction, and the third support member and the seat member are stacked in between the first support member and the second support member, wherein when the portable potty is in the collapsed position, the second support member is disposed in a top most position, the first support member is disposed in a bottom most position, the seat member is disposed within a recessed portion of the first support member, and the third support member is disposed within a recessed portion of the second support member, and wherein when the portable potty is in the constructed position, the seat member is disposed perpendicular to the first, second and third support members such that a space is formed, the space being bordered by the first, second and third support members.

2. The portable potty of claim 1, further comprising a latch disposed on a top edge of the first support member, the latch configured to secure the second support member to the first support member when the portable potty is in the collapsed position.

3. The portable potty of claim 1, further comprising a connector disposed on a side edge of the third support member, the connector configured to secure the third support member to the first support member when the portable potty is in the constructed position.

4. The portable potty of claim 1, wherein the second support member comprises a ledge extending along a width of the second support member, and when the portable potty is in the constructed position, the seat member rests upon the ledge.

5. The portable potty of claim 4, wherein the seat member is connected to the first support member at a location offset from a top edge of the first support member, and the ledge is disposed on the second support member at a location offset from a top edge of the second support member such that when the portable potty is in the constructed position, an L-shaped ledge configured for secure seating is formed between the seat member and the first and second support members.

6. The portable potty of claim 1, wherein the seat member is substantially triangular.

7. The portable potty of claim 1, wherein the first, second and third support members are substantially rectangular.

8. The portable potty of claim 1, wherein at least one of the seat member, the first support member, the second support member and the third support member has rounded corners.

9. The portable potty of claim 1, further comprising:

a disposable liner configured to be disposed within the space bordered by the first, second and third support members; and a plurality of fasteners disposed on the seat member and configured to secure the disposable liner.

10. The portable potty of claim 1, further comprising a pocket disposed on the first support member, the pocket configured to hold disposable liners for the portable potty.

11. The portable potty of claim 1, wherein bottom edges of the first, second and third support members are lined with rubber to prevent the portable potty from slipping or sliding when in use.

12. The portable potty of claim 1, wherein the seat member, the first support member, the second support member and the third support member are made of plastic.

13. The portable potty of claim 1, wherein in the collapsed position, the portable potty has a length of 8 inches or less, a width of 12 inches or less and a height of 1 inch or less.

14. The portable potty of claim 1, wherein the seat member is cushioned.

15. The portable potty of claim 1, further comprising stickers for personalizing the portable potty.

16. A method for using a portable potty comprising a triangular seat member having a first side, a second side and a third side, a first support member connected to the seat member, a second support member connected to the first support member, and a third support member connected to the second support member, the method comprising:

constructing the portable potty into a constructed position in which the seat member is disposed substantially perpendicular to the first, second and third support members such that a space is formed, the space being bordered by the first, second and third support members, the first side of the seat member contacts the first support member, the second side of the seat member contacts the second support member, and the third side of the seat member contacts the third support member; and collapsing the portable potty into a collapsed position in which the first support member and the second support member are stacked substantially parallel with respect to an adjacent member, in a vertical direction, such that the second support member is disposed in a top most position and the first support member is disposed in a bottom most position, wherein the seat member is disposed within a recessed portion of the first support member, and the third support member is disposed within a recessed portion of the second support member.

17. The method of claim 16, wherein constructing the portable potty into the constructed position from the collapsed position comprises:

unlatching a latch disposed on a top edge of the first support member to release the second support member from the first support member;

unfolding the second support member from the first support member by rotating the second support member about a connection between the first and second support members;

flipping the seat member up and away from the first support member by rotating the seat member about a connection between the first side of the seat member and the first support member;

unfolding the third support member from the second support member by rotating the third support member about a connection between the second and third support members;

connecting the third support member to the first support member via a connector disposed on a side edge of the third support member; and pushing downwards on the seat member such that the first side of the seat member contacts the first support member, the second side of the seat member contacts the second support member and the third side of the seat member contacts the third support member.

18. The method of claim 16, wherein collapsing the portable potty into the collapsed position from the constructed position comprises:

pulling upwards on the seat member such that the second side of the seat member no longer contacts the second support member and the third side of the seat member no longer contacts the third support member;

disconnecting the third support member from the first support member by disconnecting a connector disposed on a side edge of the third support member;

folding the third support member onto the second support member by rotating the third support member about a connection between the second and third support members;

flipping the seat member downwards to a position parallel to the first support member by rotating the seat member about a connection between the first side of the seat member and the first support member;

folding the second support member onto the first support member by rotating the second support member about a connection between the first and second support members; and latching a latch disposed on a top edge of the first support member to secure the second support member to the first support member.

19. The method of claim 16 further comprising:

inserting a disposable liner in the space bordered by the first, second and third support members and securing the disposable liner in fasteners disposed on the seat member, when the portable potty is in the constructed position; and removing the disposable liner from the space bordered by the first, second and third support member prior to collapsing the portable potty to the collapsed position.

* * * * *